United States Patent [19]

Uhri

[11] Patent Number: 4,583,784

[45] Date of Patent: Apr. 22, 1986

[54] USE OF FOAM AS A BOREHOLE GROUND SUPPORT SYSTEM

[75] Inventor: Duane C. Uhri, Grand Prairie, Tex.

[73] Assignee: Mobil Oil Corporation, New York, N.Y.

[21] Appl. No.: 571,179

[22] Filed: Jan. 16, 1984

[51] Int. Cl.[4] ..... E21C 37/06; E21C 45/00

[52] U.S. Cl. ..... 299/11; 299/17; 405/258; 405/288

[58] Field of Search ..... 405/258, 288, 289; 299/11, 12, 16, 17, 18; 166/273, 305 R

[56] References Cited

U.S. PATENT DOCUMENTS

| | | | |
|---|---|---|---|
| 3,155,177 | 11/1964 | Fly | 299/17 X |
| 3,273,643 | 9/1966 | Billings et al. | 166/309 X |
| 3,335,792 | 8/1967 | O'Brien et al. | 166/273 |
| 3,439,953 | 4/1969 | Pfefferle | 299/17 |
| 3,478,520 | 11/1969 | Andy | 299/11 X |
| 3,491,832 | 1/1970 | Raza | 166/273 X |
| 3,892,442 | 7/1975 | Janssen | 405/288 X |
| 3,893,511 | 7/1975 | Root | 166/305 R |
| 3,951,457 | 4/1976 | Redford | 299/17 X |
| 4,232,741 | 11/1980 | Richardson et al. | 166/305 R |

FOREIGN PATENT DOCUMENTS

| | | | |
|---|---|---|---|
| 3117027 | 11/1982 | Fed. Rep. of Germany | 299/17 |

*Primary Examiner*—Cornelius J. Husar
*Assistant Examiner*—Nancy J. Stodola
*Attorney, Agent, or Firm*—Alexander J. McKillop; Michael G. Gilman; Charles A. Malone

[57] ABSTRACT

A method is disclosed which allows an overburdened area over an underground mine cavity to be supported by the initiation of foam on liquid retained in the cavity which liquid results from the hydraulic borehole mining of minerals in the cavity.

20 Claims, 3 Drawing Figures

USE OF FOAM AS A BOREHOLE GROUND SUPPORT SYSTEM

BACKGROUND OF THE INVENTION

1. Field of the Invention

This invention is directed to a method for providing support and stabilization to an underground mine cavity which has been penetrated by at least one drilled hole by the use of foam to pressurize the underground mine cavity while it is being hydraulically mined.

2. Description of the Prior Art

One of the greatest concerns in hydraulic borehole mining is the possibility of a catastrophic cavity collapse during the mining process. This is always a pending danger when, as in existing procedures, the pressure in the cavity is reduced to essentially atmospheric conditions. When the reduction to atmospheric pressure occurs, the integrity of the cavity is maintained primarily by the beam strength of the ceiling and the shear strength of the walls. In order to avoid or minimize the possibility of a cavity collapse, it is beneficial and sometimes necessary to maintain a positive pressure within the cavity.

Underground support has been provided by inflatable flexible containers of various shapes and sizes. A good explanation of some of these prior art containers can be found in U.S. Pat. No. 2,990,166 to M. A. Walsh. As shown in the Walsh patent, proper support is provided when the inflated containers span the roof to floor and come into bearing contact with them (column 4, lines 5–14). One disadvantage with these types of supports is that they provide immediate support only to the mine bearing surfaces in contact therewith and perhaps a small adjacent roof area. Thus, in auger mining where the boreholes may easily be 100 or more feet in length and around 18 to 60 inches in diameter an exceedingly large, and expensive inflatable support would have to be provided to fill the borehole cavity. Obviously, the presence of an inflatable container within an underground cavity would preclude use of a hydraulic borehole mining tool since contact could not be made by the fluid cutting jet with the materials to be mined.

Another method that has been used in the past to support the overburden, especially in tunnelling, is referred to as the plenum process or compressed-air method. A book entitled "Practical Tunnel Driving," by Harold Richardson and Robert S. Mayo—1975 McGraw Hill Book Co. (1st Edition 1941) on pages 275–300 describe this method. Another description is found in the book "Tunnels and Tunnelling" edited by C. A. Pequignot, Hutchinson and Co., Ltd., London (1963), pages 158 to 184. Essentially, this method provides compressed air to a tunnel lining which has been locked off from the free air side to allow the working face area to be under increased air pressure. Depending on such variables as the ambient materials making up the tunnel, the depth below water level, and the safety considerations for the workers, the pressure and amount of compressed air is determined and controlled to prevent the water and surrounding material from collapsing on the workers or from exploding outwardly towards the surface of the water.

U.S. Pat. No. 4,072,015 to R. J. Morrell discloses a method and apparatus to provide temporary ground support in a mine. After an auger or other type of hole has been bored into an underground mine, at least one inflatable bladder with a fluid conduit therethrough is inserted into the hole. Once the bladder is inflated it extends to fill the diameter of the hole and to act as a plug. Thereafter, fluid is forced through the fluid conduit past the bladder and into the hole cavity to act in conjunction with the bladder as a ground support for the hole. Appropriate fluids, including foams, valves, meters, and conduits are placed at the input to the fluid conduit to control and measure the fluid being forced into the bladder and the hole cavity. Morrell's patent differs from applicant's invention because insertion of a bladder into an underground mine cavity would preclude the mining of the hydrocarbonaceous materials as practiced by applicant.

Richardson et al., U.S. Pat. No. 4,232,741, have used self-foaming aqueous solutions to temporarily plug subterranean reservoirs. This was accomplished by injecting an aqueous liquid solution which contains nitrogen gas-generating reactants, a foaming surfactant and a pH controlling system arranged so that the solution remains relatively unreactive within the well but forms a relatively immobile foam within the pores and other openings within the reservoir formation. Richardson's et al patent differs from applicant's invention in that the foam generated is immobile and the foam is utilized in a subterranean formation into which a well is completed. Applicant's invention utilizes a mobile foam floating on water within a subterranean reservoir without a well.

Until now no one has disclosed a method for generating a mobile foam within the reservoir during the borehole mining of minerals which foam generates sufficient pressure to serve as a overburden support system.

SUMMARY

The present invention is directed to a method for providing a foam support for the overburden created in a borehole mining area by mining the area with a hydraulic mining tool. The mining tool has a means for dislodging and a means for removing discarded minerals from said hole in the mine, operating the mining tool in a manner sufficient to cause the dislodged minerals to exit to the surface for further processing which dislodging causes a cavity to be formed, and continuously generating a foam within the cavity which foam has sufficient pressure to support the ground above the mine cavity but insufficient pressure to fracture the mine cavity.

More specifically the method of this invention, for providing ground support to a borehole mining area, includes the steps of drilling a hole into the working face of a mine containing the minerals to be mined, placing a hydraulic borehole mining tool having at least one liquid cutting jet, operating the hydraulic borehole mining tool in a manner to cause liquid emitted from a cutting jet to dislodge minerals from the horizon being mined in which liquid in the mine cavity formed is utilized to transport the dislodged minerals to the surface for further processing, continuously generating a foam in the cavity. The foam pressurizes the cavity sufficiently to support the ground above the mine cavity without fracturing the ground in the area of the mined cavity, rotating continuously the hydraulic borehole mining tool through a horizontal plane which causes the liquid emitted from at least one jet to be ejected through the foam and dislodge the minerals from the mine horizon.

BRIEF DESCRIPTION OF THE DRAWING

The drawing represents a schematic of a borehole mining tool device which depicts how the liquid from the jet cutting nozzle penetrates the foam floating on the liquid or water ejected from the jet cutting nozzle and which has partially filled the cavity.

DESCRIPTION OF PREFERRED EMBODIMENTS

Figure 2:
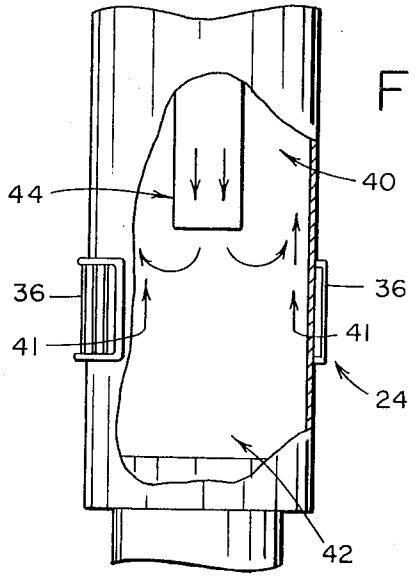
FIG. 2 is a cut away view of the mining section of the mining tool.

This invention in its broadest sense is applicable to either an auger type mining device or a hydraulic borehole mining device. Of course, the invention will work with any mining device wherein a circumferential hole is placed into the mined area and a cavity is created. The device, when placed into the circumferential hole where the mining occurs, should seal sufficiently to prevent pressure leakage due to the foam generated in the cavity.

Numerous foaming agents may be used in the present invention to manufacture the foam. For example, polyoxyethylated alkyl phenols such as Triton X-102 and Triton X-165 marketed by Rohm and Haas Company; alkyl aryl polyethylene glycol ether detergents such as Igepals marketed by General Aniline and Film Corporation; reaction products of ethylene oxide with fatty acid amides marketed as Ethomid by Armour and Company; condensation products of ethylene oxide with a propylene oxide-propylene glycol reaction product marketed as Pluronics by Wyandotte Chemical Corporation are typical non-ionic surface active agents which may be used. In general, non-ionic foaming agents are preferred since they have substantially no tendency to react with subterranean brines. However, anionic surface agents such as Triton QS-15 or cationic surface active agents such as the Arquads marked by Armour and Company may be used. Licorice extracts and protein hydrolyzates may also be used. Of course, many other foaming agents may be used, e.g., those disclosed on pages 12 and 13 of United States Bureau of Mines Monograph 11 entitled, "Using Foaming Agents to Remove Liquids From Gas Wells," by Dunning, Eakin and Walker, the disclosure of which is incorporated herein by reference.

Similarly, a wide variety of foam initiating materials may be used in the present invention. Among the primary amines which may be used are alkyl amines such as ethyl amine, propyl amine and hexyl amine, alkylene amines such as ethylene diamine and propylene diamine; alkanol amines such as monoethanolamine, N-aminoethyl ethanol-amine, monoisopropanolamine and polygycolamine and aryl amines such as N-aminophenylmethylcarbinol, methybenzylamine, aniline and o-toluidine. Among the amides which may be used are acetamide, propionamide, formamide and butyramide. The amino acids used in the present invention should be water soluble amino acids which possess a primary amino group, e.g., glycine, alanine, valine, phenylalanine and glutamic acid. It is preferred to use an inorganic nitrite salt as the source of the nitrous acid used in the present invention. Typical nitrite salts are sodium nitrite, potassium nitrite, and calcium nitrite. However, any nitrite salt which will function as a source of nitrous acid may be used.

In practice, enough foaming agent should be introduced into the well to produce a strong foam. In general, a concentration of at least about 0.01% to about 1% have been found to be satisfactory. The foaming agent may be diluted with water, brine, or organic solvents for introduction into the boreholes. Proportions of foaming agent and solvent may be varied within a broad range, so long as the viscosity of the mixture is kept low enough to enable it to flow readily into the reservoir. In general, the solvent may vary from 10 to 90%, with a range of 50 to 70% being preferred in many cases. Alcohol has been found to be a convenient organic solvent. It has also been found desirable in many cases to first introduce the solution of foaming agent into the reservoir and then wash it down with water.

The foam initiating reactants may then be added. This can be accomplished by packaging the nitrite salt and nitrogen-containing compound in the same or in separate water soluble containers and dropping them into the reservoir. The water soluble containers function to prevent reaction between the nitrite and the nitrogen-containing composition until these materials are at the desired depth in the reservoir which will usually be at or near the bottom of the reservoir. Other suitable means for delaying the reaction between the nitrogen-containing composition and the nitrite may be used e.g., adding these compositions in the same or separate breakable containers and then breaking the containers when they have reached the desired depth.

When the nitrogen-containing composition is an amide or primary amine, the additional acid which is needed to react with the nitrite to form nitrous acid may be added separately or may be combined with the nitrogen-containing materials.

When the nitrous acid and nitrogen-containing composition react, nitrogen gas is evolved which initiates foaming of the foaming agent. Other inert gases and hydrocarbon gases will function equally as well and their use is affected only by their availability. These gases include propane, methane, ethane and butane as examples.

In general, it has been found that the concentration of foam initiating material should be from about 50 p.p.m. to about 5,000 p.p.m. However, it will be readily apparent to those skilled in the art that these limits may be varied depending upon the actual conditions which are encountered in the reservoir. Since the nitrous acid and nitrogen-containing material react stoichiometrically, it is preferred that they be present in an equimolar ratio with respect to the amine group since one mole of nitrous acid will react with one mole of available amine or amide. Similarly, when primary amines or amides are used as the nitrogen-containing compound, it is preferred that the hydrogen ions of the additional acid, e.g., acetic acid, be added on an equimolar basis with respect to the nitrite group in the nitrite salt. However, an excess of any reactant will not hinder the operation of the present invention, but will only result in a certain amount of waste to the extent that the excess of a given reactant does not react. Furthermore, in the practice of the present invention, only routine experimentation will be required to determine suitable concentrations and proportions of the materials used.

Figure 1:
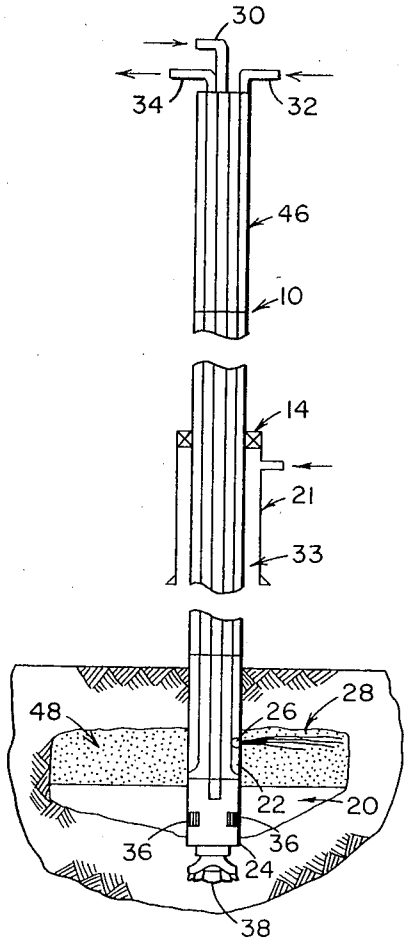
FIG. 1 is a side view of the mining tool within a cavity containing water and foam.

Although the foams mentioned above can be generated in situ, the foams can also be generated above ground and directed into the formation through the annulus between the borehole mining tool (10) and the casing (21) which is shown as conduit (33) in FIG. 1. This annulus is sealed at the surface with rotating packer (14). Required piping can be arranged by those skilled in the art to either inject foam continuously or intermittently to maintain the desired level of foam within the cavity being mined. To accomplish this it will be only necessary to have sufficient holding tanks for the components necessary to generate the foam.

Foams can be generated with either acid, water, water-methanol, or hydrocarbon carbon type stimulation fluids. Surfactants used to generate these foams are stable to 175°-300° F. depending upon the fluid type. Surfactant concentrations are generally 1% or less of total liquid volume. Foams can be designed to withstand pressures up to 10,000 psi.

Foam has excellent fluid loss properties due to its structure. Before a foam bubble can occupy a pore space, its radius of curvature must become half the diameter of the pore. The pressure across a film face is inversely proportional to the radius of curvature. Fine texture foam will cause multiple film faces in the pores. This will result in a very high differential pressure preventing further fluid loss.

Typical foam viscosities can vary between 10-100 cps. This viscosity plus the structure of the foam form an excellent medium for solids support.

Many foam stimulation systems contain 65 to 90% nitrogen gas. Nitrogen gas is inert and only slightly soluble in formation fluids. Therefore, it will not cause an emulsion or precipitate to form. The reduction of liquid volume by as much as 90% makes a specialized fluid designed for specific formation chacteristics more economical.

The types of foam and amount of foam required will depend upon various operating parameters which are known to those skilled in the art. S. R. Grundmann and D. L. Lord also mentioned other methods of making foam. These methods are included in a paper entitled "Foam Stimulation," Paper SPE 9754 which was presented at the SPE Production Operation Symposium. Prior to selecting a foam it must be decided how far down the mining tool will operate, what is the nature and composition of the overburden through which the tool will operate, the circumference of the area to be mined, the amount and compositon of materials to be removed from the cavity, and the availability of the foaming agent, e.g. nitrogen, methane, ethane, or propane. Once it has been decided to mine a particular horizon, a hole is drilled into the surface to be mined and the desired foam is selected. The size of the hole will vary depending upon the mining equipment to be placed therein. A smaller hole, of course, will be required in those situations where a borehole mining tool is going to be used. As previously mentioned, this invention can be used in either an auger type mining device or a hydraulic borehole mining device.

In one embodiment of this invention, a borehole mining tool is placed into a hole which has been drilled into the horizon to be mined and mining by use of the tool is commenced. The mining tool is suspended from a crane or drilling rig and is operated in the manner known to those skilled in the art. One such tool is described by Fly in U.S. Pat. No. 3,155,177, which is hereby incorporated by reference in its entirety.

Recovery of minerals by hydraulic mining and jet pumping of aqueous mineral slurries is well known. For example, Redford, U.S. Pat. No. 3,951,457, discloses the hydraulic method in which hot water or steam is introduced into a subterranean deposit at high velocity to dislodge bitumen and particles of sand from the surrounding mineral bed. The resulting aqueous pulp is pumped to the surface by means of another high velocity jet of hot water or steam. Pfefferle, U.S. Pat. No. 3,439,953, discloses another apparatus for hydraulic mining. The U.S. Department of the Interior, Bureau of Mines, has sponsored development of a tool for single borehole slurry mining in which a stream of cutting jet water is pumped at very high pressure to a point adjacent the bottom of the borehole and is directed generally laterally at very high velocity into the surrounding mineral body to dislodge the mineral and form an aqueous pulp. The aqueous pulp is conveyed to the surface using a jet pump powered by a second stream of high pressure, high velocity water. Additional information on this system is available to the public from Flow Industries, Inc., 21414 68th Ave., South Kent, Wash. 98031.

Figure 3:
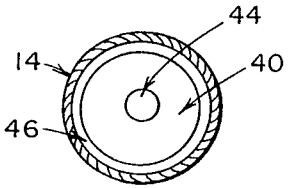
FIG. 3 is a cross surface view of the mining tool surrounded by a rotating packer.

Referring to the Figures, once the mining tool has been placed into the hole, a liquid cutting jet emits a high-pressure liquid, preferably water from the nozzle (26) of the borehole mining tool. The force of the water emitted from the jet in nozzle section (26) impacts on the minerals contained in the mine and dislodges same causing the minerals to fall to the bottom of the cavity. Once the minerals have fallen to the bottom of the cavity, a tricone head (38) is used to drill further into the cavity and to stabilize the borehole mining tool. In certain borehole mining tools, the tricone head can be used to take into the main body some of the minerals which have fallen to the bottom of the cavity. The minerals are then transmitted into the mixing chamber (42), FIG. 2, of the borehole mining tool via screens (36) which exclude the larger mined particles thereby preventing blockage. A gas lift (44), FIGS. 2 and 3, causes a lifting type action in the slurry mixing chamber (42) which causes the dislodged minerals and water to exit through line (34) in FIG. 1.

Cutting jet water or liquid (28), FIG. 1, continues to exit from the borehole mining tool and mining continues as the cavity begins filling with the liquid or water. Once sufficient minerals are mined and there is a danger that the weight of the overburden will collapse into the mined cavity, foam (48), FIG. 1, is generated above ground and is caused to enter the borehole mining tool through conduit (33) in FIG. 1. The foam is generated continuously while the jet nozzle (26) continues to emit the high pressure cutting water (28) against the cavity wall. As the foam is emitted, along with the water or aqueous liquid, sufficient foam is caused to float on top of the water in the mine cavity until the foam contacts the roof and exposed sides of the cavity. The borehole mining tool is operated in a horizontal plane so that the cutting water (28) continues to impact upon the exposed cavity area cutting through the mobile floating foam. After cutting through the foam, additional foam is generated which causes pressure to be exerted against the exposed walls and ceiling.

As the high pressure cutting water (28) continues to traverse the cavity and mine same, it cuts through the foam with little resistance. The foam is continuously replaced so that the cavity remains filled with foam above the surface of the liquid or water. Whether sufficient foam is in the cavity can be determined by the amount of back pressure generated on conduits (33) and (32). Alternatively, various level indicators can be utilized as is known by those skilled in the art.

The foam generating and removal of mined materials can continue until such time as it becomes uneconomical to continue mining in the area. When this occurs the borehole mining tool can be removed from the hole and the area allowed to collapse under its own weight. If it is necessary to prevent collapse, the cavity can be backfilled with tailings. In those situations where it is desired to do so, a polyurethane foam can be generated in situ and allowed to become solid. After the polyurethane foam has solidified, sufficient pressure will be generated by the polyurethane foam to support the overburden. As previously mentioned, the nature and amount of the polyurethane foam as with the other foams will depend upon the depth of the mine, makeup of the overburden, and the area which has been mined.

Although the foam which is generated in the embodiment above is made above ground and directed into the cavity, another embodiment of this invention discloses generating the foam in situ. In this embodiment, mineral mining has commenced and mining continues for a time sufficient to present a danger of the cavity collapsing. Mining is then terminated and a selected foam component package is dropped through the hole drilled into the cavity. Methods for making desired foams are taught in U.S. Pat. Nos. 3,273,643, 3,893,511 and 4,232,741 by W. E. Billings et al., P. J. Root, and Richardson et al. respectively. These patents are incorporated by reference herein in their entirety.

As contemplated this method could be equally applicable to the mining of coal, tar sands, oil shale, and any other solid hydrocarbonaceous matter in an underground environment.

Although the invention has been described relative to exemplary embodiments thereof, it will be understood by those skilled in the art that variations and modifications can be effected in this embodiment without departing from the scope and spirit of the invention.

What is claimed is:

1. A method for providing support to an overburden area penetrated by at least one drilled hole from which minerals are hydraulically mined from an underground cavity or reservoir containing a liquid comprising:

(a) introducing foam within the cavity which foam floats on said liquid causing pressure to be exerted against the interior of said cavity sufficient to support said overburden area; and (b) removing said minerals from within said cavity with a hydraulic borehole mining tool while said foam is introduced.

2. The method as recited in claim 1 where the foam is introduced continuously into the cavity while minerals are removed continuously from the cavity by a hydraulic borehole mining tool.

3. A method for providing support to an overburden area penetrated by at least one vertically drilled hole from which minerals are mined from an underground cavity or reservoir via water emitted from a hydraulic borehole mining tool comprising:

(a) establishing a water level in said cavity or reservoir;

(b) mixing a foaming agent with water emitted from a fluid jet of the borehole mining tool said emission producing an aqueous solution of the foaming agent within the cavity;

(c) adding a foam initiator composition capable of evolving nitrogen to said solution within the cavity; and (d) allowing said foam initiator composition to evolve nitrogen creating a foam comprising an aqueous liquid and gas within the cavity where said foam floats on the surface of said water and generates a pressure within said cavity sufficient to support said overburden.

4. The method as recited in claim 3 where steps (b) and (c) are repeated continuously.

5. The method as recited in claim 3 where in step (b) the foaming agent comprises a member selected from the class consisting of nonionic, anionic and cationic surface active agents and mixtures thereof.

6. The method as recited in claim 3 where in step (d) the foam pressure exceeds the original pressure in the cavity but does not exceed the fracture pressure of the cavity.

7. The method as recited in claim 3 where in step (d) a foam is created in the cavity after the desired amount of minerals have been mined which foam supports the overburden.

8. A method for proving support to an overburden area penetrated by at least one vertically drilled hole from which minerals are mined from an underground cavity or reservoir via water emitted from a borehole mining tool comprising:

(a) adding a foaming agent to the water retained in the cavity which causes the foaming agent and water to mix which mixing produces an aqueous solution of said foaming agent within the cavity;

(b) adding a foam initiator composition to the solution in said cavity which foam initiator comprises a composition selected from the group consisting of nitrous acid and compositions capable of forming nitrous acid and a composition selected from the class of primary amines, sulfamic acid, amides, amino acids and mixtures thereof, said foam initiator being capable of evolving nitrogen gas; and (c) allowing said foam initiator composition to evolve nitrogen gas which forms an aqueous foam, which foam floats on said water, said foam and nitrogen gas causing pressure to be exerted within the cavity.

9. The method as recited in claim 8 where said foam initiator composition comprises sulfamic acid.

10. The method as recited in claim 8 where said foam initiator composition comprises a primary amine.

11. The method as recited in claim 8 where said foam initiator composition comprises an amide.

12. The method as recited in claim 8 where said foam initiator composition comprises an amino acid.

13. The method as recited in claim 8 where said foam initiator composition comprises a water-soluble amino acid which possesses a primary amino group.

14. The method as recited in claim 8 where said foaming agent comprises a member selected from the class consisting of nonionic, anionic and cationic active agents.

15. The method as recited in claim 8 where said foam initiator comprises an acid.

16. The method as recited in claim 8 where the constituents of said foam initiator composition are enclosed in a water soluble container at the time said constituents are added to the water in the cavity.

17. The method as recited in claim 8 where the constituents of said foam initiator composition are enclosed in separate water-soluble containers at the time the constituents are added to the water in the cavity.

18. The method as recited in claim 8 where in step (c) the foam pressure exceeds the original pressure in the cavity but does not exceed the fracture pressure of the cavity.

19. The method as recited in claim 8 where in step (c) the foam is created in the cavity after the desired amount of minerals have been mined which foam supports the overburden.

20. The method as recited in claim 19 where a polyurethane foam is created and allowed to solidify in the cavity after the desired amount of minerals have been mined, which solidified foam supports the overburden.

* * * * *